US005363624A

United States Patent [19]

Cotter

[11] Patent Number: 5,363,624

[45] Date of Patent: Nov. 15, 1994

[54] ROOFING AND SIDING SYSTEM

[75] Inventor: Donald P. Cotter, Livermore Falls, Me.

[73] Assignee: Cotterco, Inc., Livermore Falls, Me.

[21] Appl. No.: 169,732

[22] Filed: Dec. 17, 1993

Related U.S. Application Data

[63] Continuation of Ser. No. 939,030, Sep. 2, 1992, abandoned, which is a continuation of Ser. No. 685,237, Apr. 12, 1991, abandoned.

[51] Int. Cl.[5] ..... E04D 1/34; E04D 1/36

[52] U.S. Cl. ..... 52/547; 52/544; 52/545; 52/546; 52/528; 52/466

[58] Field of Search ..... 52/543, 544, 545, 546, 52/547, 528, 520, 478, 489, 573, 715, 461, 466, 537, 542

[56] References Cited

U.S. PATENT DOCUMENTS

| | | | |
|---|---|---|---|
| 2,408,557 | 10/1946 | Huntington . | |
| 2,855,871 | 10/1958 | Huntington . | |
| 4,034,532 | 7/1977 | Reinwall, Jr. | 52/520 |
| 4,184,299 | 1/1980 | East . | |
| 4,213,282 | 7/1980 | Heckelsberg | 52/404 |
| 4,361,998 | 12/1982 | Ellison et al. | 52/520 |
| 4,400,924 | 8/1983 | Andrews . | |
| 4,417,431 | 11/1983 | Commins et al. | 52/715 |
| 4,495,743 | 1/1985 | Ellison et al. | 52/478 |
| 4,575,983 | 3/1986 | Lott, Jr. et al. | 52/547 |
| 4,583,339 | 4/1986 | Cotter . | |
| 4,641,475 | 2/1987 | Berridge | 52/466 |
| 5,181,360 | 1/1993 | Shingler | 52/547 |
| 5,187,911 | 2/1993 | Cotter | 52/545 |
| 5,222,341 | 6/1993 | Watkins et al. | 52/547 |
| 5,230,192 | 6/1993 | Webb et al. | 52/545 |

*Primary Examiner*—Carl D. Friedman
*Assistant Examiner*—Wynn E. Wood
*Attorney, Agent, or Firm*—Graham & James

[57] ABSTRACT

Sheet metal roofing or siding batten system (10) and standing seam system (30) are disclosed. The batten system (10) comprises pan (11), mounting bracket (16) and batten (23) sections. The standing seam system (30) comprises pan (31) and mounting bracket (32) sections. Both mounting bracket designs include a base (13,33), upwardly extending .legs (15,35), and downwardly extending securing legs (16,36) having inwardly extending protrusions (17,37) used to secure lateral borders (28 and 38,39) of the pans to the brackets. The invention ensures positive interlock of the components while allowing for thermal expansion and variations in pan geometry inherent in metal roofing systems.

4 Claims, 2 Drawing Sheets

ROOFING AND SIDING SYSTEM

This is a continuation of application Ser. No. 07/939,030, filed Sep. 2, 1992, now abandoned, which is a continuation of Ser. No. 07/685,237, filed Apr. 12, 1991, now abandoned.

BACKGROUND OF THE INVENTION

The present invention relates to systems for roofing or siding and more particularly to batten systems and standing seam systems comprising elongate planar sheets and attachment brackets with or without battens.

Sheet metal and batten roofing systems are well known. Representative systems include U.S. Pat. Nos. 4,001,995 and 4,583, 339 to the present applicant, U.S. Pat. Nos. 2,408,557 and 2,855,871 to Huntington, and No. 4,400,924 to Andrews. These systems generally employ numerous elongate planar sheets which are placed side-by-side to cover the exposed surface of a building. Attachment brackets of various designs are used to secure the panels to the building surface. Battens are mounted over the joints to provide weather proofing.

Using the modern technology of portable job-site manufacturing, roofing panels can be produced hundreds of feet long and not be limited by common carrier lengths. This eliminates unsightly lap joints and potential leaks. However, the panels are commonly made from lightweight material which undergoes significant thermal expansion and deformation. For example, an aluminum panel 200' long expands more than 2' in length when subjected to temperature changes in excess of 100° F. In the prior art systems the expansion and deformation can lead to loss of integrity. The panels can become unlocked and moisture can penetrate through to the building, or the panels can be uplifted by the wind.

Installation of the brackets of the prior art systems is often labor intensive, since an installer is precariously positioned on a sloped roof handling tools, brackets and fasteners in an awkward fashion. It is not uncommon for the brackets to slide off the roof and injure workmen below who are struck by their sharp corners and edges. Prior art systems can thus be difficult and costly to install and may not maintain their integrity against leaks.

SUMMARY OF THE INVENTION

The invention provides a roofing or siding system of simple, foolproof assembly that is less costly and safer to install than the prior art with a guarantee the components are interlocked properly. Mounting brackets are disclosed having a base portion for mounting to a building subsurface by common fasteners, and a clip portion for capturing and securing the upwardly extending lateral borders of longitudinal pans which are laid over the building surface. The clip portion has an upwardly (that is away from the building surface) extending, vertical leg and downwardly (that is towards the building surface) extending securing legs with dimpled protrusions to hold the pan lateral borders.

The mounting bracket can be used with batten-type roofing and siding systems. The systems include generally planar strips or pans having upwardly extending lateral borders which are laid across the subsurface of a building. Mounting brackets are of the type disclosed above with two downwardly extending securing legs, one on each side of the vertical leg of the clip portion, for securing the pan lateral borders. A batten cap, which springs into place over the bracket and pan lateral borders, is used to weatherproof the joint. An audible snap or popping sound occurs when the batten is mounted, which assures the installer that there has been an interlock of the parts.

A similar interlock and mounting bracket can also be used with standing seam-type roofing and siding system. When an engineer, architect, or contractor elects to use this of roofing it is usually when a change in direction is not required. It is also used on a sloped roof in one length. Economics or design influence the choice. This profile utilizes male and female vertical lateral pan borders rolled into one piece that interlocks with the mounting bracket. Unlike the batten system type mounting bracket, which has securing flanges that are formed opposite each other, this bracket has one downturned flange to interlock with the female side of the panel. The insurance of audible noise and guarantee of interlock are the same as with the batten system type.

Both batten system and standing seam system type style pans preferably have offsets at their bases to create a small void at the bracket location. This void allows clearance for the fastener and also accommodates any minor tolerance in manufactured components to be permissible.

The novel features and further objects of the invention will be better understood from consideration of the following description and drawings in which the preferred embodiments of the invention are illustrated. The drawings are for illustration only and not intended as limits of the invention.

DESCRIPTION OF THE PREFERRED EMBODIMENT

Figure 1:
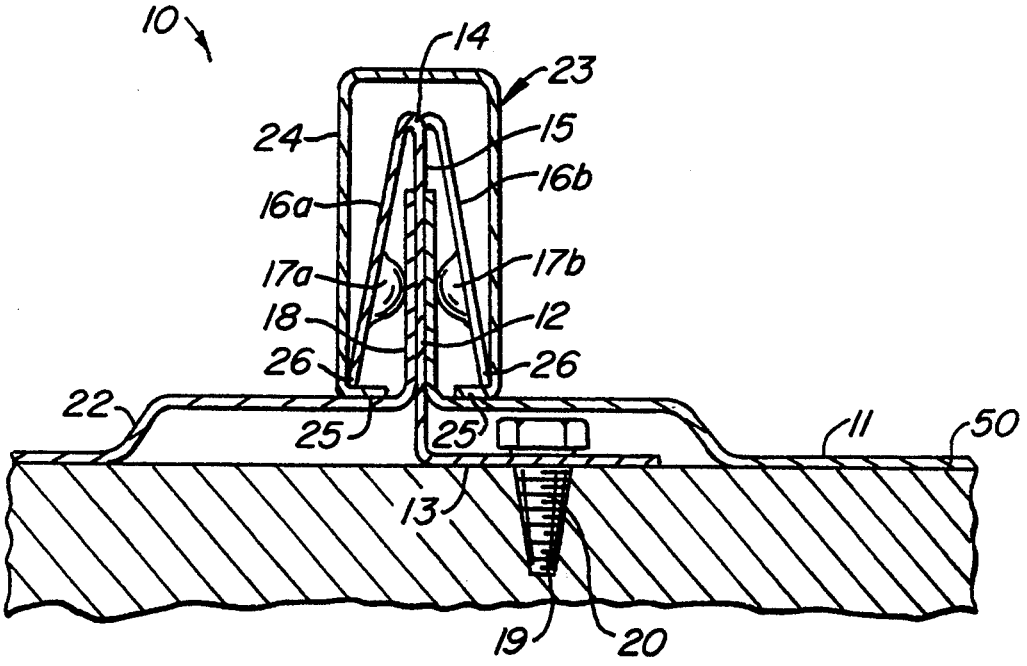
FIG. 1 is a section across a joint in the batten-type roofing or siding system of the present invention showing a mounting bracket, parts of two pan sections, and a batten.
Figure 2:
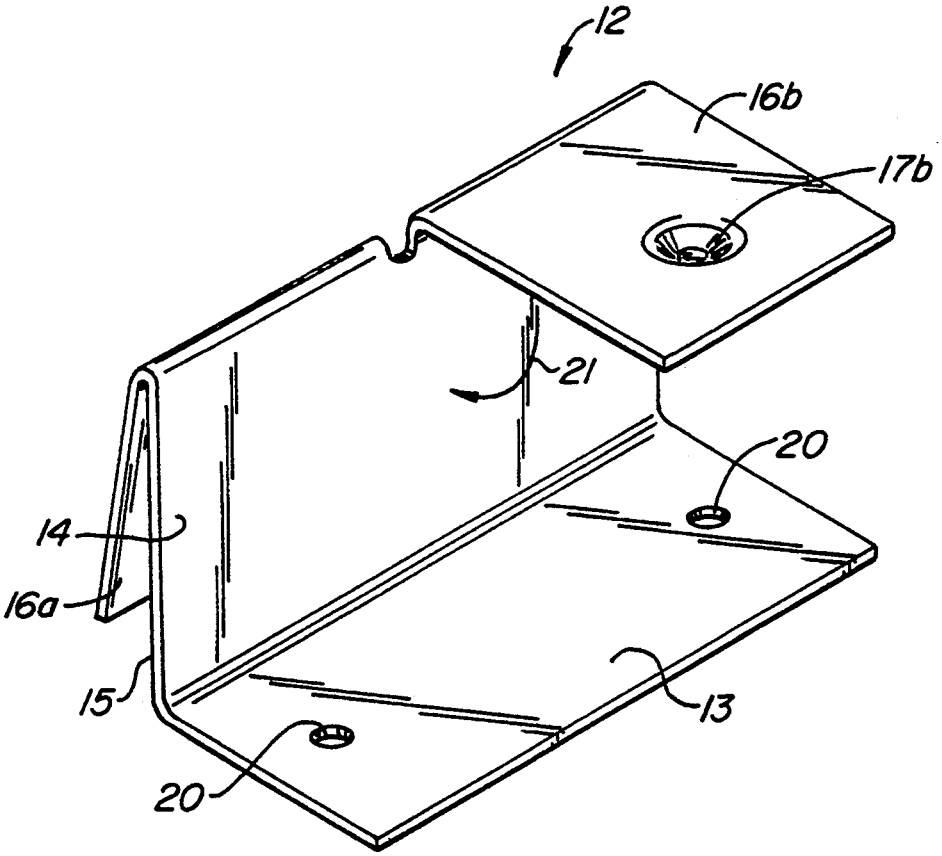
FIG. 2 is an isometric projection of a mounting bracket of FIG. 1 prior to being field formed.

Referring to FIG. 1, the batten system 10 includes repetitions of pan strip 11, mounting bracket 12, and batten cap 23 anchored to a building framework or surface 50. Bracket 12, shown in FIG. 2 in its preformed condition, is typically steel. Although the following refers to a roofing system, system 10 can be used either as roofing or siding, or both. Mounting bracket 12 includes a base portion 13 and a clip portion 14. The clip portion 14 includes an outwardly extending, vertical leg 15 essentially perpendicular to the base portion 13, and two (or more) inwardly extending securing legs **16*a*, 16*b*, each having at least one protrusion or dimple 17*a*, 17*b*. System 10 is constructed by first placing a pan strip 11 in position on building surface 50 to be covered with the vertical leg 15 of mounting bracket 12 placed adjacent to the vertical lateral border 18 of pan strip 11. Mounting bracket 12 is temporarily secured to border 18 by pinching border 18 between projection 17*a* and vertical leg 15. Conventional fasteners, such as screws 19, are passed through holes 20 in base 13 to secure bracket 12 to surface 50. The base 13** can also be secured by other means.

After a roof-length of mounting brackets 12 are anchored, another pan strip 11 is placed parallel to vertical leg 15 of mounting bracket 12, with pan vertical lateral border 18 touching mounting bracket vertical leg 15. The voids created by offsets 22 in the lateral pans 11 cover fastener 19, regardless of which side base 13 is positioned, to provide for a smooth uninterrupted look and effective weatherproofing. Securing leg **16*b* is then bent into place over the vertical lateral border 18, as shown by arrow 21, using sheet metal pliers or an equivalent tool until a protrusion 17*b*, formed in leg 16*b*, contacts vertical lateral border 18. Protrusions 17*a*, 17*a*** are typically hemispherically-shaped, but can take other forms, such as slotted, as long as there is material to create a protrusion or dimple.

This bracket design has the further advantage that it accepts pan vertical lateral borders 18 of variable height. Variations in height can occur when the pan strip 11 is cut to some tolerance at a mill prior to forming, or when the pan strips 11 are formed from stock in the field.

After adjacent lateral borders 18 of pan strips 11 have been secured to the building framework or surface 50 by brackets 12, a batten cap 23, as shown in FIG. 1, is installed. Cap 23 is made of resilient material such as sheet metal or plastic, and is overformed. The sides 24 of the cap are pulled apart to permit the flanges 25 to span the securing legs **16*a*, 16*b* which have been formed over pan vertical lateral borders 18. As the flanges 25 of the cap clear the bottom edges 26 of the securing legs 16*a*, 16*b*, the cap 23 is released and springs shut around the mounting bracket 12. An audible snapping sound is heard which assures the installer that there has been interlock. The batten cap 23 and the pan strip 11** can slide together or even separately relative to the bracket to allow for expansion and contraction of the sheets when exposed to temperature changes. Differential expansion and buckling are avoided.

Figure 4:
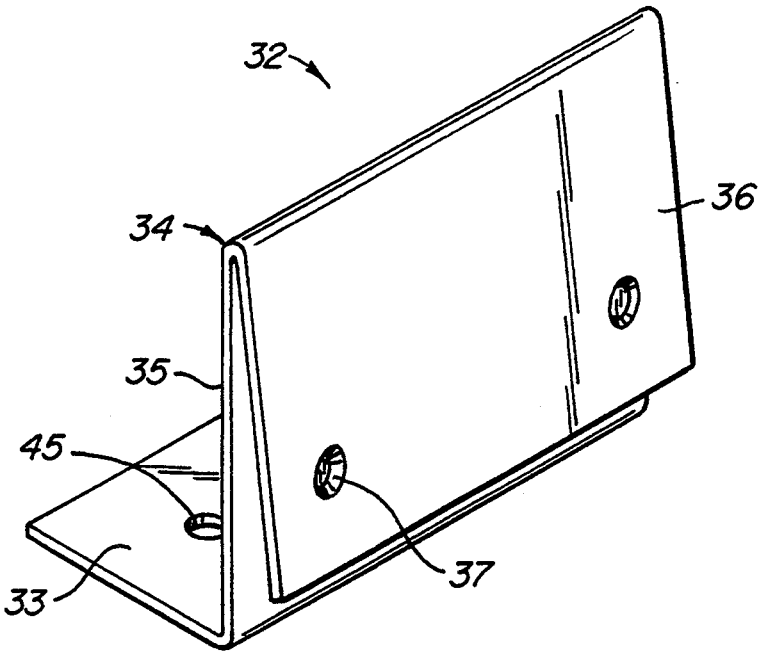
FIG. 4 is an isometric projection of a mounting bracket of FIG. 3.
Figure 3:
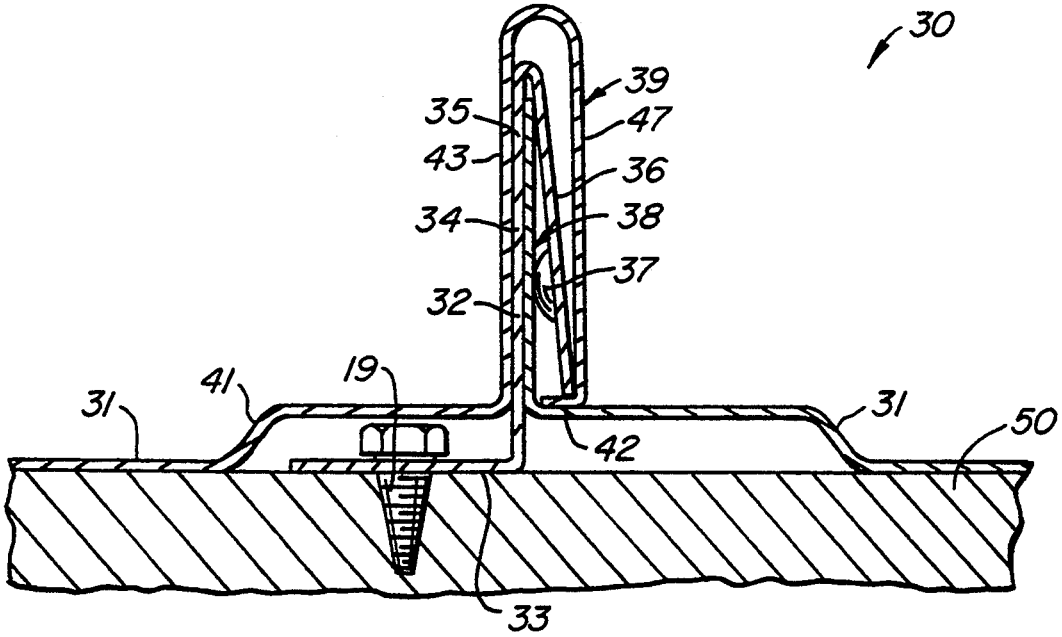
FIG. 3 is a section across a joint in a standing seam-type roofing or siding system of the present invention showing a mounting bracket and parts of two pan sections.

An alternative embodiment of the invention is shown in FIGS. 3 and 4, referred to in this application as the standing seam system 30, comprising repetitions of pan strip 31 and mounting bracket 32, anchored to a building framework or surface 50. Again, the system can be used for roofing or siding, although standing seam system 30 is generally used only where there is no change in direction, such as at a roof peak. The roof is constructed by first placing a pan strip 31 in position on a building surface 50 to be covered and then installing mounting bracket 32 over the single thickness male vertical lateral border 43.

Mounting bracket 32 shares the same characteristics as the previously described bracket 12, including a base portion 33 and a clip portion 34, which includes a vertical leg 35 and a securing leg 36 with one or more protrusions 37. However, this bracket 32 has only one securing leg 36, which requires no field forming. The vertical leg 35 of the mounting bracket 32 is placed adjacent to the male vertical lateral border 38 of the pan strip 31 to capture border 38 between leg 35 and protrusions 37. Mounting bracket 32 is secured to surface 50 by conventional fasteners such as screw 19 through holes 45 in base 33.

After a roof-length of mounting bracket 32 is anchored, another pan strip 31 is laid, this time with the female vertical lateral border 39 engaging the male vertical lateral border 38 of the adjacent pan and the vertical leg 35 of the mounting bracket 32. The voids created by offsets 41 in the lateral pans 31 again cover fasteners 19. The female vertical lateral border 39 is typically an inverted U-shape with an inwardly directed single thickness flange 42 at its lower end. The vertical legs 43, 47 of the female lateral border 39 are spaced slightly less apart than the maximum width of the mounting bracket 32 in its deformed shape. This ensures a positive secure connection between the mating panels 31.

To install the second panel, the vertical legs 43, 47 are pulled apart to enable the flange 42 to override the securing leg 36. When flange 42 passes the bottom edge 44 of the securing leg 36, the U-shape border 39 springs shut around the mounting bracket 32. This creates a loud snapping sound which again assures the installer that there has been positive interlock. The pans 31, although held in place against each other laterally, can slide together or even separately longitudinally relative to the bracket to allow for thermal expansion.

Both systems 10 and 30 are quickly, easily and safely installed with a minimum of tools. However, their design ensures that the pans will not lift or separate from their underlying surface while allowing thermal expansion.

Preferred embodiments have been illustrated in detail, modifications and adaptations of which will occur to those skilled in the art. However, such modifications and adaptations are within the spirit and scope of the present invention, as limited only by the following claims.

What is claimed is:

1. A system for mounting a pan, used in roofing and siding systems, to a building surface, the pan including a panel portion and an upwardly extending lateral border, the system comprising:

a bracket including a base portion mountable to the building surface; and a clip portion connected to the base portion, the clip portion including a first leg extending away from the base portion having a first length and a top end, and a second leg extending at an acute angle from the top end of the first leg towards the base portion, the second leg having a second length, a distal edge and a protrusion extending towards the first leg, the second length being shorter than the first length to form a flange gap between the distal edge and the base, the protrusion positioned and sized to form a narrow bracket slot between the protrusion and the first leg configured to fictionally retain the clip portion on the lateral border and thereby substantially eliminate undesired sliding of the clip portion relative to the lateral border while the base portion is unsecured to the building surface; and a longitudinal batten cap configured to generally overlap the bracket and the pan lateral border, the cap including a side wall terminating at a laterally extending flange forming a shoulder therebetween, wherein when the lateral border ia positioned in the narrow bracket slot and the cap is installed over the bracket, the second leg is biased toward the first leg by the side wall to cause the protrusion to bias the lateral border against the first leg and thereby promote frictional engagement therebetween, the flange and the flange gap configured to mate together and retain the cap in a substantially fixed vertical position relative to the base.

2. The system of claim 1 wherein the protrusion is a dimpled protrusion generally hemispherical in shape and spaced apart from the distal edge.

3. A roofing and siding system for mounting to a building comprising:

a plurality of longitudinal pans having substantially flat central panels, for mounting against a building surface, and upwardly, that is away from the building surface, extending lateral borders;

a bracket, including a base portion mountable to the building surface and a clip portion including an upwardly extending first leg, having a top end, and a second leg extending at an acute angle downwardly, that is towards the building surface, from the top end, the first and second legs defining a first narrow bracket slot therebetween for receipt of a first lateral border therein, the second leg configured to include a first dimpled protrusion extending inwardly toward the first leg sized and positioned to fictionally capture the lateral border between the dimpled protrusion and the first leg and thereby retain the clip portion upon the lateral border and substantially preventing undesired sliding movement of the bracket relative to the lateral border before installation, the first leg including first and second sides with the second leg extending adjacent the first side;

the clip portion further comprising a third leg extending at an acute angle downwardly, that is generally towards the building surface, from the top end of the first leg adjacent the second side defining a second narrow bracket slot therebetween for receipt of a second lateral border therein, the third leg having a second dimpled protrusion extending inwardly toward the first leg sized and positioned to fictionally capture a second lateral border between the dimpled protrusion and the first leg, the second and third legs each having a distal edge defining bottom flange gaps between the distal edges of the second and third legs and the longitudinal pans; and a longitudinal batten cap sized to cover the bracket and pan lateral borders, the batten cap having first and second side walls, the first side wall terminating at a first laterally extending flange and the second side wall terminating at a second laterally extending flange, the first and second flanges positioned for mounting within the bottom flange gaps and sized for complementary mating engagement in the flange gaps therein with the flanges occupying a substantial portion of the respective bottom flange gap to retain the cap in a substantially fixed vertical position relative to the base.

4. A roofing system comprising a first and second longitudinal pan each having substantially flat central panels, for mounting against a building surface, and upwardly, that is away from the building surface, extending lateral borders;

a bracket including a base portion mountable to the building surface and a clip portion, the clip portion including an upwardly extending first leg having a top end and first and second sides, a second leg extending at an acute angle downwardly, that is generally towards the building surface, from the top end of the first leg adjacent the first side terminating at a first distal end, and a third leg extending at an acute angle downwardly, that is generally towards the building surface, from the top end of the first leg adjacent the first side terminating at a second distal end;

a first flange gap formed between the first distal end and the first panel;

a second flange gap formed between the second distal end and the second panel;

a first dimpled protrusion extending outwardly from the second leg towards the first side of the first leg defining a narrow bracket slot therebetween fictionally capturing a first of said lateral borders between the first protrusion and the first side of the first leg to thereby retain the bracket upon the first lateral border;

a second dimpled protrusion extending outwardly from the third leg towards the second side of the first leg defining a narrow bracket slot therebetween fictionally capturing a second of said lateral borders between the second protrusion and the second side of the first leg; and a longitudinal batten cap sized to cover the bracket and the first and second lateral borders, the batten cap having first and second side walls, the first side wall terminating at a first laterally extending flange extending into the first flange gap and the second side wall terminating at a second laterally extending flange extending into the second flange gap, the first and second flanges substantially filling the first and second flange gaps to thereby restrict vertical movement of the cap relative to the base, the first and second side walls biasing the first and second protrusions towards the first leg to thereby maintain constant frictional engagement between the first and second lateral borders and the first leg while allowing thermal movement therebetween.

* * * * *